US008544721B2

(12) United States Patent
Sauter

(10) Patent No.: US 8,544,721 B2
(45) Date of Patent: Oct. 1, 2013

(54) DEVICE FOR HANDLING BANKNOTES

(75) Inventor: Stefan Sauter, München (DE)

(73) Assignee: Giesecke & Devrient GmbH, Munich (DE)

( * ) Notice: Subject to any disclaimer, the term of this patent is extended or adjusted under 35 U.S.C. 154(b) by 716 days.

(21) Appl. No.: 12/439,377

(22) PCT Filed: Aug. 1, 2007

(86) PCT No.: PCT/EP2007/006817
§ 371 (c)(1),
(2), (4) Date: Oct. 6, 2009

(87) PCT Pub. No.: WO2008/025429
PCT Pub. Date: Mar. 6, 2008

(65) Prior Publication Data

US 2010/0065623 A1 Mar. 18, 2010

(30) Foreign Application Priority Data

Aug. 31, 2006 (DE) ..... 10 2006 040 780

(51) Int. Cl.
*A45C 1/12* (2006.01)

(52) U.S. Cl.
USPC ..... 232/1 D; 235/379

(58) Field of Classification Search
USPC ..... 232/1 D, 15, 16, 43.2; 209/534; 271/9.13; 705/35; 902/12, 17, 21; 235/379; 194/206, 217
See application file for complete search history.

(56) References Cited

U.S. PATENT DOCUMENTS

| | | | | |
|---|---|---|---|---|
| 4,697,708 | A | 10/1987 | Goto et al. | |
| 4,866,254 | A | 9/1989 | Okayama et al. | |
| 5,021,639 | A | 6/1991 | Hara et al. | |
| 5,553,320 | A * | 9/1996 | Matsuura et al. | 235/379 |
| 5,813,510 | A | 9/1998 | Rademacher | |
| 5,864,826 | A | 1/1999 | Awatsu et al. | |
| 6,378,770 | B1 | 4/2002 | Clark et al. | |
| 6,523,742 | B1 * | 2/2003 | Awatsu et al. | 235/379 |
| 6,805,343 | B2 * | 10/2004 | Kosugi | 271/147 |

(Continued)

FOREIGN PATENT DOCUMENTS

| | | | |
|---|---|---|---|
| DE | 19626981 | A1 | 1/1998 |
| DE | 102004024620 | A1 | 5/2005 |
| EP | 0692599 | A1 | 1/1996 |
| EP | 0881605 | A1 | 2/1998 |

OTHER PUBLICATIONS

IBM Corp; "Automatic Transaction Facility" IBM Technical Disclosure Bulletin; Bd. 28, Nr. 3, Aug. 1985, XP002058709.

*Primary Examiner* — William Miller
(74) *Attorney, Agent, or Firm* — Bacon & Thomas, PLLC

(57) ABSTRACT

The invention relates to an apparatus for processing bank notes, in particular a compensation unit for adapting the bank-note stock of a recycling apparatus. In recycling apparatus standing in the cash offices of retailers a lack of bank notes of small denominations occurs quickly. In order to render the filling and emptying of the bank-note stock of recycling apparatus easy and safe, and to extend the time intervals for refilling and emptying recycling apparatus and thereby operate them in an economically sensible fashion, a compensation unit is connected to the recycling apparatus, in which bank notes of certain types are stored. It is possible to both transfer bank notes from the recycling apparatus to the compensation unit and to feed bank notes from the compensation unit to the recycling apparatus.

28 Claims, 2 Drawing Sheets

(56) References Cited

U.S. PATENT DOCUMENTS 6,824,046 B2 * 11/2004 Brexel et al. ..... 235/379
7,857,198 B2 * 12/2010 Bell ..... 232/1 D
7,950,512 B2 * 5/2011 Folk et al. ..... 194/200
8,019,663 B1 * 9/2011 Bohen et al. ..... 705/30
2005/0116407 A1 6/2005 Minamishin et al.
2008/0283451 A1 11/2008 Holl et al.

* cited by examiner

DEVICE FOR HANDLING BANKNOTES

BACKGROUND

A. Field

The invention relates to an apparatus for processing bank notes, and in particular a compensation unit for adapting the bank-note stock of an apparatus for accepting and dispensing bank notes. Furthermore the invention relates to a system for accepting, storing and dispensing bank notes with this compensation unit as well as a method for adapting the bank-note stock.

B. Related Art

From DE 10 2004 024 620 A1 a bank-note recycling apparatus is known which has one or several pockets for depositing false or suspicious bank notes and several cassettes for temporarily storing the bank notes accepted as authentic. Bank notes of different denominations can be kept available in the respective cassettes separately from each other for later dispensing.

In addition to their use in the banking sector, recycling apparatus are increasingly also used in the cash offices of retailers. Despite the possibility of accepting and storing cash money and dispensing money for money-changing actions or refilling cash registers, recycling apparatus are unbalanced relatively quickly. A lack of bank notes of small denominations occurs rapidly. The reason for this is that at the cash desks very frequently bank notes of large denominations are paid in and in return small denominations are given as change, which are then missing also in the recycling apparatus after emptying the cash registers. In order to keep the recycling apparatus in balance and to thus run it in an economically sensible manner in the first place, bank notes of small denominations have to be fed manually very frequently on a daily basis—representing both a security risk and a high time and cost expenditure.

BRIEF SUMMARY

It is therefore an object of the invention to render the filling and emptying of the bank-note stock of recycling apparatus easy and safe and to extend the time intervals for refilling and emptying recycling apparatus.

The object is solved in that an apparatus for accepting and dispensing bank notes, hereinafter referred to briefly as recycling apparatus, is connected to a compensation unit in which bank notes of certain denominations are stored. The compensation unit has at least one first storage device storing bank notes of a first type, and at least one second storage device storing bank notes of a second type, wherein the second type differs from the first type. The compensation unit constitutes an additional storage possibility for bank notes for the recycling apparatus and thus complements already existing bank-note storage devices integrated in the recycling apparatus and/or arranged within it. Furthermore the compensation unit can have a housing of its own arranged outside the recycling apparatus. However, it is equally possible to arrange the compensation unit within the housing of the recycling apparatus, wherein in this case the housing of the recycling apparatus preferably has one or several doors for accessing the compensation unit or the individual storage devices of the compensation unit. Between the recycling apparatus and the compensation unit connected thereto bank notes can be exchanged in both directions. For this purpose transport means are provided, with which bank notes can be transported out of or into the storage devices of the compensation unit. The storage devices are for example respectively one or several lockable cash cassettes. By connecting the compensation unit, which supplies small-denomination bank notes from a first storage unit and removes surplus bank notes of certain, for example larger denominations to a second storage unit, the bank-note stock of the recycling apparatus can be adapted and kept in balance.

At least one storage device of the compensation unit stores bank notes of a first type which can consist of one or several first denominations, and at least one second storage device of the compensation unit stores bank notes of a second type which can also consist of one or several second denominations. The term "type of bank notes" thus for example designates a certain set of denominations, however the term "different types of bank notes" is not to be interpreted as exclusive. Thus different types can also contain some identical denominations. However, in the different types at least one denomination has to be different. The term several denominations for example designates several denominations of one currency, however the term also includes several denominations of different currencies.

Preferably at least one of the second denominations is larger than the first denominations. The first type can thus consist of some of the smallest denominations of one or several currencies, preferably of one or several of the three smallest denominations of one or several currencies. These can be for example one or several of the denominations 5, 10, 20. Particularly preferably the first type has one or several of the denominations which are dispensed most frequently by the cash register or by the recycling apparatus. The stock of those bank notes which are missing most rapidly in the cash register or in the recycling apparatus can thus be adapted in a targeted fashion.

By using a compensation unit which is connected to the recycling apparatus, bank notes can be stored separately from the recycling apparatus. By transferring bank notes of relatively large denominations to a storage device of the compensation unit bank notes can be stored more securely than in the recycling apparatus. It is a further advantage that the delivery and removal of cash cassettes by a security transport company is facilitated, since cash cassettes can be inserted and removed without accessing the recycling apparatus. Both for removing cash cassettes, containing e.g. bank notes earned by the retailer, and for delivering cash cassettes, containing e.g. change for the cash register, consequently the cash cassettes have to be removed only from the compensation unit, but the recycling apparatus does not need to be opened. An advantageous effect is also that the exchange of cash cassettes by the security transport company is expedited, since no authentication for accessing the recycling apparatus needs to take place. Since the capacities for storing bank notes can furthermore be expanded by the compensation unit, also the time intervals after which the earnings have to be collected by a security transport company can be reduced.

To facilitate accounting the system of recycling apparatus and compensation unit automatically logs every bank-note transfer. The data (e.g. number, state, denominations) of both the bank notes inserted in or dispensed by the recycling apparatus and the bank notes transported from the recycling apparatus to the compensation unit and vice versa are registered and stored individually. The logs of the bank-note transfer or parts of these logs are for example stored in a memory area of the evaluation unit of the recycling apparatus and/or in further data memories allocated to the individual storage devices of the compensation unit. Preferably the information on the factual stock in a storage device can be stored in a data memory which is firmly connected to the respective storage device, such as e.g. a cash cassette. The bank-note stocks of the bank-note storage devices of the recycling apparatus and the storage devices of the compensation unit can also be made available electronically and, if required, can be transmitted to the outside via a data line. The information on the bank-note stock of the individual delivered or collected storage devices, such as e.g. the individual cash cassettes, can be transmitted by the system of recycling apparatus and compensation unit also to the security transport company or to the cash center and/or also in the reverse direction.

An inventive system of recycling apparatus and compensation unit can for example be used in the cash offices of retailers. The retailer for example feeds the daily receipts to the system and fills his cash register with bank notes from the system. However, it is equally possible to use the system as a deposit apparatus with change function, at which the customers or the final consumers can pay directly. In this case no money transfer to and from a customer cash register to the system is necessary. The system can be used e.g. directly instead of a customer cash register.

The storage devices can preferably be removed from the compensation unit and/or inserted in the compensation unit individually. Therein no access to the recycling apparatus needs to take place, i.e. it can remain locked during inserting and/or removing storage devices, e.g. by the security transport company. Vice versa also for filling and emptying the recycling apparatus, such as carried out e.g. for transferring bank notes from the or into the customer cash register, no access to the compensation unit is necessary. The recycling apparatus can be filled with bank notes in stacks and/or bank notes can be removed from the recycling apparatus in stacks, wherein the compensation unit can remain locked. The separate money circuits between the customer cash register and the recycling apparatus of the system on the one hand and between the security transport company and the compensation unit of the system on the other hand result in an increased security of the overall money transfers.

DESCRIPTION OF THE DRAWINGS

The invention will hereinafter be described by way of example with reference to the accompanying drawings.

The figures are described as follows.

DESCRIPTION OF ILLUSTRATIVE EMBODIMENTS

Figure 1:
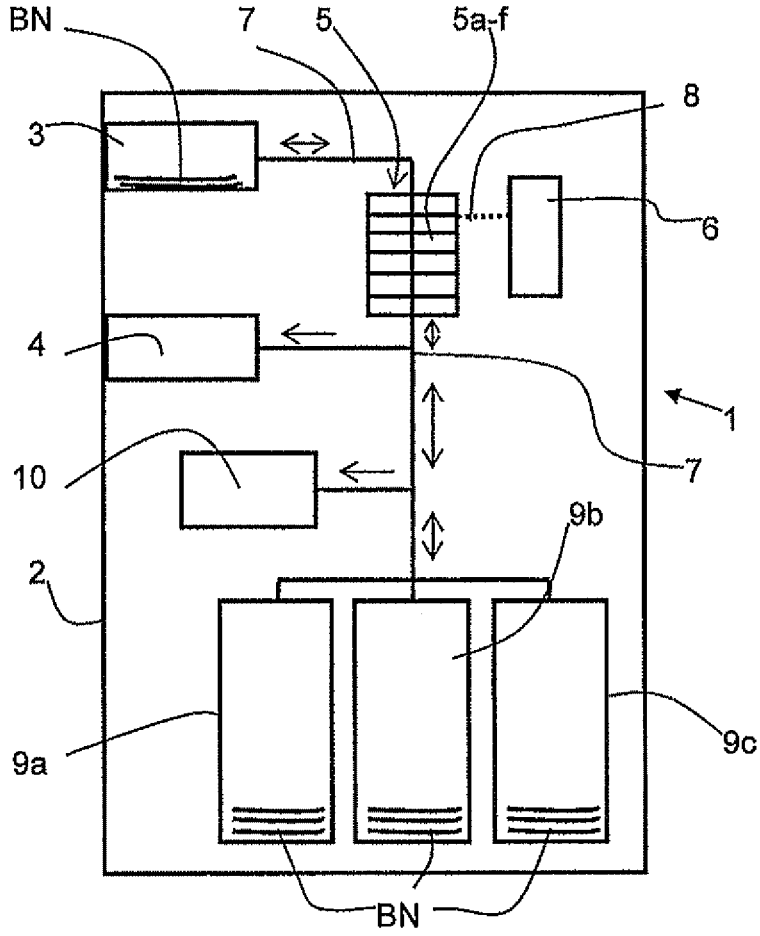
FIG. 1 a recycling apparatus into which bank notes can be inserted from the outside, stored and dispensed again, FIG. 2 an exemplary system of a recycling apparatus and a compensation unit connected thereto with the interfaces of the system for bank-note exchange toward the outside.

FIG. 1 is a schematic view of an example of a recycling apparatus 1, which can be used for accepting, storing and dispensing bank notes. In the housing 2 of the recycling apparatus 1 an input pocket 3 is integrated that is accessible from the outside, into which during a deposit transaction a stack of bank notes to be deposited can be inserted. The bank notes 3 inserted in the input pocket 3 are singled and transported by a transport system 7 through a sensor unit 5 in which the authenticity, the denomination and the state of the bank notes is checked. The evaluation of the sensor results therein takes place in a computer-based evaluation unit 6 connected to the sensor unit 5 via a data line 8, which evaluation unit can also be a component of the sensor unit 5. In dependence on the results of the evaluation unit 6 switches in the transport system 7 are controlled, which divert the checked bank note either into an output pocket 4 for unrecognized bank notes which is accessible from the outside, into one of several bank-note storage devices 9*a-c* for bank notes accepted as authentic or into one of possibly several storage boxes 10 for false or suspicious bank notes. The bank-note storage devices 9*a-c* and the storage boxes 10 are not accessible from the outside. In the bank note storage devices 9*a-c* the checked bank notes are stored among the already stored bank notes separated according to denomination. During a payout transaction the bank notes to be paid out from the bank-note storage devices 9*a-c* are singled and dispensed by means of the transport system 7 into the output pocket 4. In the recycling apparatus 1 thus bank notes deposited during a deposit transaction can be kept and these bank notes can be dispensed again during subsequent payout transactions. In FIG. 1 the possible transport paths of the bank notes within the recycling apparatus are indicated by arrows.

The sensor unit 5 comprises several sensor modules 5*a-f*, measuring different physical and/or chemical properties of a deposited bank note. As sensor modules 5*a-f* for example an image sensor module 5*a*, a magnetism sensor module 5*b*, a conductivity sensor module 5*c*, a UV sensor module 5*d* and an IR sensor module 5*e* are used, in order to be able to determine the format, the printed image, the magnetism, the conductivity, the lack of brightener, the degree of soiling and status in other respects (holes, tears, dog ears, etc.) of the checked bank notes. In the recycling apparatus 1 also the luminescence radiation, in particular preferably both fluorescence and phosphorescence radiation, of feature substances integrated in the paper or the printing ink can be measured in an additional sensor module 5*f* of the sensor unit 5.

Preferably not only the deposited bank notes, but also those paid out during a payout transaction, are once again checked for number, authenticity and/or denomination. This can take place either with an extra sensor unit or a common sensor unit 5, as shown by way of example in FIG. 1, in which both the deposited bank notes and the paid-out bank notes pass the sensor unit 5 and are dispensed into the pocket 3 simultaneously also serving for the manual removal of bank notes. The measuring values recorded by the sensor modules 5*a-f* are fed to the evaluation device 6 and are subsequently evaluated by the evaluation unit 6. Therein the deposited bank notes are classified according to different categories, for example: category 1 (not recognized), 2 (false), 3 (suspicious) or 4 (authentic). The bank notes classified as authentic are subdivided in dependence on their state into the categories 4a (fit) or 4b (unfit), i.e. are evaluated according to their fitness to be paid out again. The bank notes which were not recognized e.g. due to a double pick are immediately dispensed again to the depositor into the output pocket 4, the bank notes categorized as false or suspicious are stored separate from each other in the storage boxes 10 and the authentic bank notes are stored separate according to denomination and state in the cassettes 9*a-c*, so that the bank notes in a good state belonging to category 4a can be paid out again to other depositors during subsequent payout transactions.

Figure 2:
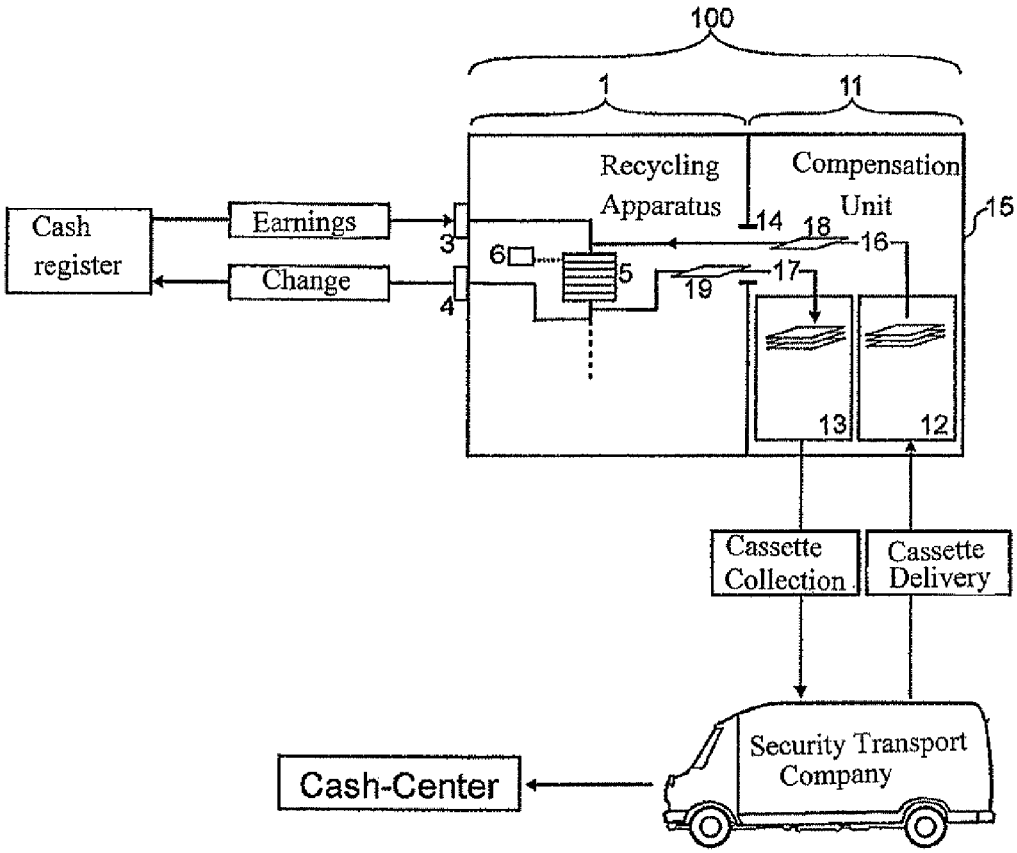

FIG. 2 shows a system 100 of a first compensation unit 11 and a recycling apparatus 1, such as described for example concerning FIG. 1 (wherein identical reference numerals are used for identical elements). This system 100 can for example be used for bank-note management in retail trading. The compensation unit 11 has a housing 15 of its own, which is arranged outside the recycling apparatus 1 and is connected to the recycling apparatus 1 in such a fashion that bank notes 18, 19 can be exchanged between the two components 1, 11. The compensation unit 11 has an opening 14 as well as a first storage device 12 and a second storage device 13. Through the opening 14 on the one hand bank notes 18 can be transported from the first storage device 12 of the compensation unit 11 into the recycling apparatus 1 and on the other hand also bank notes 19 can be transported from the recycling apparatus 1 into the second storage device 13 of the compensation unit 11. For transporting the bank notes 18 or the bank notes 19 transport means 16 or transport means 17 are provided, which can convey the bank notes 18 or the bank notes 19 from the compensation unit 11 to the recycling apparatus 1 or in the reverse direction. In an alternative embodiment the two transport means 16, 17 can also be combined to form one transport means, which can transport bank notes 18, 19 in both directions. In this case the compensation unit 11 is equipped with correspondingly controlled transport switches which can switch the transport path alternatively to each of the two storage devices 12, 13 (not shown).

In the cash register of the retail business frequently many bank notes of large denominations (from earnings) are present, and relatively few bank notes of small denominations (as change). For secure storage from time to time surplus bank notes (mostly large denominations, such as e.g. 50, 100, 200, 500) are removed from the cash register and inserted in the recycling apparatus 1. For this purpose stacks of bank notes can be placed manually into the input pocket 3 of the recycling apparatus 1. The recycling apparatus 1 processes the inserted bank notes, as described above with reference to FIG. 1, and guides the processed bank notes of the corresponding category as needed either to the bank-note storage devices 9*a-c* of the recycling apparatus 1 or directly to the storage device 13 of the compensation unit 11. The decision whether the bank notes are fed to the bank-note storage devices 9*a-c* or to the storage device 13 is for example taken in dependence on the sensor result, for example depending on the determined state or the determined denomination of the bank notes, and/or in dependence on the currently given free capacities of the storage devices 9*a-c* and 13. Alternatively the bank notes 18, 19 can also first be stored in the bank-note storage devices 9*a-c* of the recycling apparatus 1 and subsequently, for example after the closing time of the retail business, be transported out of the bank-note storage devices 9*a-c* of the recycling apparatus 1 into the storage device 13 of the compensation unit 11.

In order to balance the bank-note stock of the cash register again with reference to the small, relatively frequently paid out denominations, from time to time bank notes (mostly small denominations, such as e.g. 5, 10, 20) are collected from the recycling apparatus 1 and inserted in the cash register of the retailer.

For this purpose bank notes can be stacked automatically in the output pocket 4 of the recycling apparatus 1 and the stack can subsequently be inserted manually in the cash register, where the bank notes are available e.g. as change. The bank notes to be stacked in the output pocket 4 can, depending on the bank-note stocks in the storage devices 9*a-c* and 12, be collected from the bank-note storage devices 9*a-c* of the recycling apparatus 1 or also from the storage device 12 of the compensation unit 11. During operating hours in which the recycling apparatus 1 is currently not in use, the bank-note storage devices 9*a-c* can be automatically filled for example by transporting bank notes 18 from the storage unit 12. In this fashion a predetermined minimum filling level of bank notes can be achieved constantly in the bank-note storage devices 9*a-c* of the recycling apparatus 1.

In the storage devices 12, 13 respectively at least 1000 bank notes, preferably at least 2000 bank notes can be stored. The storage devices 12, 13 are for example two lockable cash cassettes. However, the compensation unit 11 can also be equipped with respectively two or more cash cassettes as first and second storage device. In the cash cassette 13 preferably such bank notes are stored which are relatively frequently deposited in the cash register or in the recycling apparatus 1.

With the system shown in FIG. 2 an uncomplicated exchange of the cash cassettes 12, 13 by a security transport company is possible, since when the cash cassettes are delivered and collected its employees have to access only the compensation unit and the recycling apparatus 1 can remain locked meanwhile. The retailer's earnings are usually taken to a cash center by the security transport company, where the bank notes are further processed. In this fashion it can be achieved that the cash flow between the cash register and the system 100 is independent of the cash flow between the security transport company and the system 100. In this fashion additional security can be achieved in managing bank notes in retail trading.

The invention claimed is:

1. A compensation unit configured to exchange bank-note stock of an apparatus for accepting and dispensing bank notes, said compensation unit comprising:

a housing configured to surround the compensation unit, said housing being arranged so that the housing is connectable to and outside the apparatus for accepting and dispensing bank notes, at least one first storage device and at least one second storage device arranged inside the housing, wherein the first storage device stores bank notes of a first type and the second storage device stores bank notes of a second type, and wherein the second type differs from the first type, wherein said compensation unit is a different type of apparatus than the apparatus for accepting and dispensing bank notes, and said compensation unit being directly connectable to the apparatus in such a way that the compensation unit only accepts and dispenses the bank notes from the connected apparatus to exchange the bank notes—between the compensation unit and the apparatus, said apparatus comprising bank note storage devices configured to store the checked bank notes separately according to denomination of the bank notes, wherein when said compensation unit is connected to the apparatus for accepting and dispensing bank notes, said compensation unit is configured so that automatic feeding of the bank notes of the first type from the first storage device to a first bank note storage device of the apparatus for accepting and dispensing bank notes is enabled, and wherein automatic feeding of the bank notes of the second type from a second bank note storage device of the apparatus for accepting and dispensing bank notes to the second storage device is also enabled, and wherein storage of bank notes via the compensation unit to complement the bank-note storage devices integrated into the apparatus for accepting and dispensing bank notes is enabled in order to extend the time intervals for refilling and emptying the bank-note stock of the apparatus for accepting and dispensing bank notes.

2. The compensation unit according to claim 1, including an additional storage device for accepting and dispensing bank notes, said additional storage device complementing the bank-note storage devices of the apparatus for accepting and dispensing bank notes.

3. The compensation unit according to claim 1, including at least one opening, through which bank notes are transportable from the storage devices to the apparatus for accepting and dispensing bank notes and vice versa.

4. The compensation unit according to claim 1, including transport devices which are arranged to remove bank notes of the first type from the first storage device and arranged to move bank notes of the second type to the second storage device.

5. The compensation unit according to claim 1, wherein the first type comprises one or several first denominations, wherein the first denominations have one or several of the denominations most frequently dispensed by the apparatus for accepting and dispensing bank notes.

6. The compensation unit according to claim 1, wherein the first type comprises one or several first denominations and the second type comprises one or several second denominations, wherein at least one of the second denominations differs from the first denominations.

7. The compensation unit according to claim 1, wherein the first type comprises one or several first denominations, wherein the first denominations have one or several of the smallest denominations of at least one currency.

8. The compensation unit according to claim 1, wherein the second type comprises one or several second denominations, wherein the second denominations have one or several of the largest denominations of at least one currency.

9. The compensation unit according to claim 1, wherein the storage devices are removable individually from the compensation unit.

10. The compensation unit according to claim 1, wherein the storage devices comprise cassettes.

11. The compensation unit according to claim 1, wherein at least one of the storage devices has at least one data memory in which bank-note stocks of the storage device are stored, wherein the data memory is firmly connected to the storage device.

12. The compensation unit according to claim 1, wherein the storage devices are locked in the compensation unit.

13. The system according to claim 1, wherein the apparatus for accepting and dispensing bank notes is fillable with bank notes in stacks and/or bank notes are removable in stacks from the apparatus for accepting and dispensing bank notes, wherein no access to the compensation unit needs to take place and/or wherein the compensation unit can remain locked.

14. A system for accepting, dispensing and storing bank notes comprising:

an apparatus for accepting and dispensing bank notes, said apparatus comprising bank note storage devices configured to store checked bank notes separately according to denomination of the bank notes; and a compensation unit configured to exchange bank-note stock of the apparatus for accepting and dispensing bank notes, said compensation unit comprising:

a housing configured to surround the compensation unit, said housing being arranged so that the housing is connectable to and outside the apparatus for accepting and dispensing bank notes, at least one first storage device and at least one second storage device arranged inside the housing, wherein the first storage device stores bank notes of a first type and the second storage device stores bank notes of a second type, and wherein the second type differs from the first type, wherein said compensation unit is a different type of apparatus than the apparatus for accepting and dispensing bank notes, and said compensation unit being directly connectable to the apparatus in such a way that the compensation unit only accepts and dispenses the bank notes from the apparatus to exchange the bank notes between the compensation unit and the apparatus, wherein automatic feeding of the bank notes of the first type from the first storage device to a first bank note storage device of the apparatus for accepting and dispensing bank notes is enabled, and wherein automatic feeding of the bank notes of the second type from a second bank note storage device of the apparatus for accepting and dispensing bank notes to the second storage device is also enabled, and wherein storage of bank notes via the compensation unit to complement the bank-note storage devices integrated into the apparatus for accepting and dispensing bank notes is enabled in order to extend the time intervals for refilling and emptying the bank-note stock of the apparatus for accepting and dispensing bank notes.

15. The system according to claim 14, wherein the apparatus has at least one input pocket, at least one output pocket and at least one bank-note storage device, wherein storing of the bank notes inserted in the input pocket in the bank-note storage devices is enabled and subsequently dispensing the bank notes into the output pocket is enabled.

16. The system according to claim 14, wherein the input pocket and the output pocket are identical.

17. The system according to claim 14, wherein the storage device is removable from the compensation unit and/or inserted in the compensation unit, wherein no access to the apparatus for accepting and dispensing bank notes needs to take place and/or wherein the apparatus for accepting and dispensing bank notes can remain locked.

18. The system according to claim 14, wherein the system has at least one operation mode for adapting the bank-note stock of the apparatus, in which bank notes are transportable automatically from the apparatus into the compensation unit and/or bank notes are transportable automatically from the compensation unit into the apparatus.

19. A method for exchanging bank-note stock of an apparatus for accepting and dispensing bank notes, comprising the steps:

a) providing a system having the apparatus for accepting and dispensing bank notes and a compensation unit configured to exchange bank-note stock of the apparatus for accepting and dispensing bank notes, said apparatus for accepting and dispensing bank notes comprising bank note storage devices configured to store checked bank notes separately according to denomination of the bank notes, said compensation unit including a housing configured to surround the compensation unit, said housing being arranged so that the housing is connectable to and outside the apparatus for accepting and dispensing bank notes, at least one first storage device and at least one second storage device arranged inside the housing, wherein the first storage device stores bank notes of a first type and the second storage device stores bank notes of a second type, and wherein the second type differs from the first type, wherein said compensation unit is a different type of apparatus than the apparatus for accepting and dispensing bank notes, and said compensation unit being directly connectable to the apparatus in such a way that the compensation unit only accepts and dispenses the bank notes from the apparatus to exchange the bank notes between the compensation unit and the apparatus, wherein automatic feeding of the bank notes of the first type from the first storage device to a first bank note storage device of the apparatus for accepting and dispensing bank notes is enabled, and wherein automatic feeding of the bank notes of the second type from a second bank note storage device of the apparatus for accepting and dispensing bank notes to the second storage device is also enabled, and wherein storage of bank notes via the compensation unit to complement the bank-note storage devices integrated into the apparatus for accepting and dispensing bank notes is enabled in order to extend the time intervals for refilling and emptying the bank-note stock of the apparatus for accepting and dispensing bank notes, b1) transporting bank notes of a first type from the first storage device of the compensation unit to the apparatus for accepting and dispensing bank notes; and/or b2) transporting bank notes of a second type from the apparatus for accepting and dispensing bank notes to the second storage device of the compensation unit.

20. The method according to claim 19, wherein before transporting the bank notes the apparatus is connected with the compensation unit for transferring the bank notes.

21. The method according to claim 19, wherein before the step b1 and/or the step b2 the storage devices are inserted in the compensation unit, wherein no access to the apparatus for accepting and dispensing bank notes takes place and/or wherein the apparatus for accepting and dispensing bank notes remains locked.

22. The method according to claim 19, wherein in step b1 bank notes of the first type are transported from the first storage device of the compensation unit into the output pocket of the apparatus and/or into a bank-note storage device of the apparatus.

23. The method according to claim 19, wherein in step b2 bank notes of the second type are transported from the input pocket of the apparatus and/or from a bank-note storage device of the apparatus into the second storage device of the compensation unit.

24. The method according to claim 19, wherein transporting of the bank notes of step b1 and/or of step b2 is logged and log data originating from the logging are stored during and/or after the transporting step at least partly in at least one data memory and/or at least partly in at least one memory area of at least one data memory.

25. The method according to claim 24, wherein in the data memory and/or in the memory area of the data memory at least one bank-note stock of the storage device is stored.

26. The method according to claim 24, wherein at least parts of the log data are electronically transmitted from the system and/or from the storage devices to the outside.

27. The method according to claim 24, wherein the data memory and/or the memory area of the data memory is allocated to one of the storage devices.

28. The method according to claim 24, wherein the memory area of the data memory and/or the data memory is allocated to one of the storage devices and is arranged within the system.

* * * * *